US005829097A

United States Patent [19]

Toledo

[11] Patent Number: 5,829,097

[45] Date of Patent: Nov. 3, 1998

[54] HOLD OPEN CONTROL FOR A DOOR CLOSER

[75] Inventor: George F. Toledo, Fallbrook, Calif.

[73] Assignee: Jackson Corporation, Los Angeles, Calif.

[21] Appl. No.: 653,504

[22] Filed: May 24, 1996

[51] Int. Cl.[6] ..... E05C 17/00; E05F 3/10; E05F 3/22

[52] U.S. Cl. ..... 16/53; 16/56; 16/66; 16/DIG. 17

[58] Field of Search ..... 16/53, 55, 60, 16/66, 291, 297, DIG. 17, 56

[56] References Cited

U.S. PATENT DOCUMENTS

| | | | |
|---|---|---|---|
| 1,305,676 | 6/1919 | Voight . | |
| 2,108,891 | 2/1938 | Johnson . | |
| 2,368,875 | 2/1945 | Potter . | |
| 2,700,175 | 1/1955 | Carlson | 16/55 |
| 2,880,449 | 4/1959 | Frohlich | 16/55 |
| 2,958,089 | 11/1960 | Roehm et al. . | |
| 3,246,362 | 4/1966 | Jackson . | |
| 3,601,842 | 8/1971 | Morrison et al. | 16/49 |
| 3,601,843 | 8/1971 | Jentsch | 16/53 |
| 3,630,560 | 12/1971 | Atkins et al. . | |
| 3,675,270 | 7/1972 | Jentsch | 16/53 |
| 3,702,015 | 11/1972 | Blom . | |
| 3,742,553 | 7/1973 | Sittmann . | |
| 4,064,589 | 12/1977 | Bejarano et al. | 16/53 |
| 4,506,407 | 3/1985 | Downey | 16/DIG. 17 |

*Primary Examiner*—Chuck Mah
*Assistant Examiner*—Donald M. Gurley
*Attorney, Agent, or Firm*—Hill & Simpson

[57] ABSTRACT

A blocking device for preventing a door closer from achieving a degree of rotation corresponding to a door hold-open position. A blocking device is provided which can be selectively protruded into a door closer housing to block the translation of a cam plate under influence of a rotating cam operatively connected to one of either the door or the door frame such that the 90° or 105° typical door hold open position cannot be achieved. The blocking device can be a rotatable limit bar which can be positioned to an interference or no-interference position, or it can be screw pins which can be threadingly inserted into the housing to block either the cam or other moving portions of the door closer such that the closer cannot achieve the door hold open position.

17 Claims, 4 Drawing Sheets

HOLD OPEN CONTROL FOR A DOOR CLOSER

BACKGROUND OF THE INVENTION

The present invention relates to door closers which urge a door to a closed position from an open position and which provide a mechanism for holding the door in the open or partially open position. Additionally, such door closers can be provided with means for regulating the closing speed of the door on the closing mechanism. Such door closing mechanisms are described for example in U.S. Pat. No. 3,246,362 and U.S. Pat. No. 4,064,589.

U.S. Pat. No. 3,246,362 describes a hold open arrangement for a door closer. In such an arrangement, a closer is rigidly mounted in a door frame, typically in a concealed position in the header or overhead portion of the frame. The non-circular portion of the spindle member is connected to the door to form one of the door pivots and to be turned by opening and closing the door, such as by inserting it in a mating non-circular hinge arm which is carried on the door. In a full open position, a cam follower is seated in a hold-open recess and, by virtue of the forces exerted by the springs in a direction to tend to move the pistons and hence the plate members and the follower, the follower is caused to bear firmly against the cam surface defining the recess to hold the door in a full open position. The recess is located on a portion of the cam surface having an over center relationship with respect to the pivotal motion of the cam and because of this location, additional compression of the spring with resultant axial movement of the follower is required to unseat the follower from its hold-open position.

While it may be beneficial to provide a door hold open mechanism at for example the 105° open position of a door, for temporarily holding the door open, in some circumstances, such an operative mode may be detrimental. For example, where maintaining a door in a normally closed position is desired such as for heat conservation in a building, or for balancing air flow in a heating ventilating and air conditioning system, or for fire control purposes, or for noise reduction purposes, a deactivation of a hold open mechanism is beneficial.

U.S. Pat. No. 4,064,589 for example describes a hold open cam (114) with a cam surface (118) with a pair of hold-open recesses (120, 122). Also included are means which include a pair of oppositely disposed eccentric pins (170) for deactivating the hold-open function. Each pin (170) is operatively connected eccentrically to a roller which engages in the hold-open recess of the cam, and by rotating the pin, the roller can be displaced to a non-active position with respect to engagement with the hold-open cam. A simple arrangement for preventing a door from reaching the hold open position is not disclosed.

U.S. Pat. No. 2,700,175 describes a cam which pivots to thrust a head against the urging of springs during door opening. If the door reaches a 105° open position, a roller interfits into a recess of the cam to hold the door open. To prevent the door from reaching this position, a rack bar is shifted by sliding to have its teeth clash with teeth of the head. When the rack bar is positioned for its teeth to mesh with teeth of the head, the head can proceed a sufficient distance for the roller to engage the recess in the cam.

SUMMARY OF THE INVENTION

It is an object of the invention to provide a mechanism for deactivating the hold open mechanism for a door closer which is effective, easily manually controlled, inexpensively manufactured, and of a rugged construction. It is an object of the invention to provide a mechanism for activating and deactivating a hold open arrangement in a door closer which can be set without using a hand held tool. It is an object of the invention to provide a mechanism for activating and deactivating a hold open mechanism in a door closer which can be quickly and easily controlled by a person's hand. It is an object of the present invention to provide a mechanism which requires no adjustments and positively prevents a door hold open condition in a door closer.

The objects of the invention are achieved in a door closer by a mechanism for limiting the movement of a longitudinal travelling member which is engaged by a cam to move upon rotation of the cam, the cam rotating with the pivoting door. The longitudinal member typically provides pistons connected to rods which are connected to a cam plate assembly, the assembly having facing plates with rollers therebetween with the cam residing between the facing plates and pressing the rollers along a cam surface during movement of the plate assembly. The pistons are typically reciprocated in cylinders filled with hydraulic fluid for controlling the closing speed of the door. The pistons are biased to a door close condition by springs arranged longitudinally within the housing. The mechanism of the invention can provide a positive stop of the longitudinal travelling arrangement at a number of places within the housing. A lever can be provided at a back end of the housing, close to the spindle and cam which, when activated positions a bar to block further movement of the cam plates in a door opening direction, to prevent the door from reaching the position where a hold open function is achieved.

The hold open function is achieved by the door reaching a 90° or 105° open position wherein the cam surface is provided with a recess which temporarily engages a roller of the cam plate to temporarily lock the spindle and cam plate in position against the urging of the door closer springs. However, if this position cannot be reached due to the mechanism of the present invention, the door cannot be placed in the hold open condition and the door will be consistently urged to the closed position by the door closer springs.

The mechanism, in one embodiment, is a limit bar arranged generally horizontally and sized to interfit between the facing cam plates when in a first orientation. In a second orientation the limit bar diverges from the horizontal, and the limit bar interferes with movement of the cam plates in a door opening direction by placing the bar between a back wall of the housing and the cam plates wherein the limit bar cannot, due to its orientation, interfit between the facing cam plates. The orientation of the limit bar is controlled by a shaft which protrudes out of the housing and can be adjusted by a lever or alternatively by a hand tool.

In another arrangement, screw pins are arranged protruding into the housing and extendable to interfere with the longitudinal movement of the pistons. When extended into the housing to interfere with the pistons, the screw pins are located such that the cam plates are stopped before the cam can rotate into the door hold open condition. Alternatively, these pins can be arranged to abut the cam itself preventing the cam from rotating to the full door open angle.

DETAILED DESCRIPTION OF THE PREFERRED EMBODIMENTS

The present invention consists of an improved door closer and is illustrated in an embodiment of the spring actuated, hydraulic-pot type, such as that disclosed in U.S. Pat. Nos. 3,246,362 and 4,064,589. The present invention provides for a mechanism for effectively deactivating a hold open arrangement incorporated in the cam and cam plate assembly.

Figure 1:
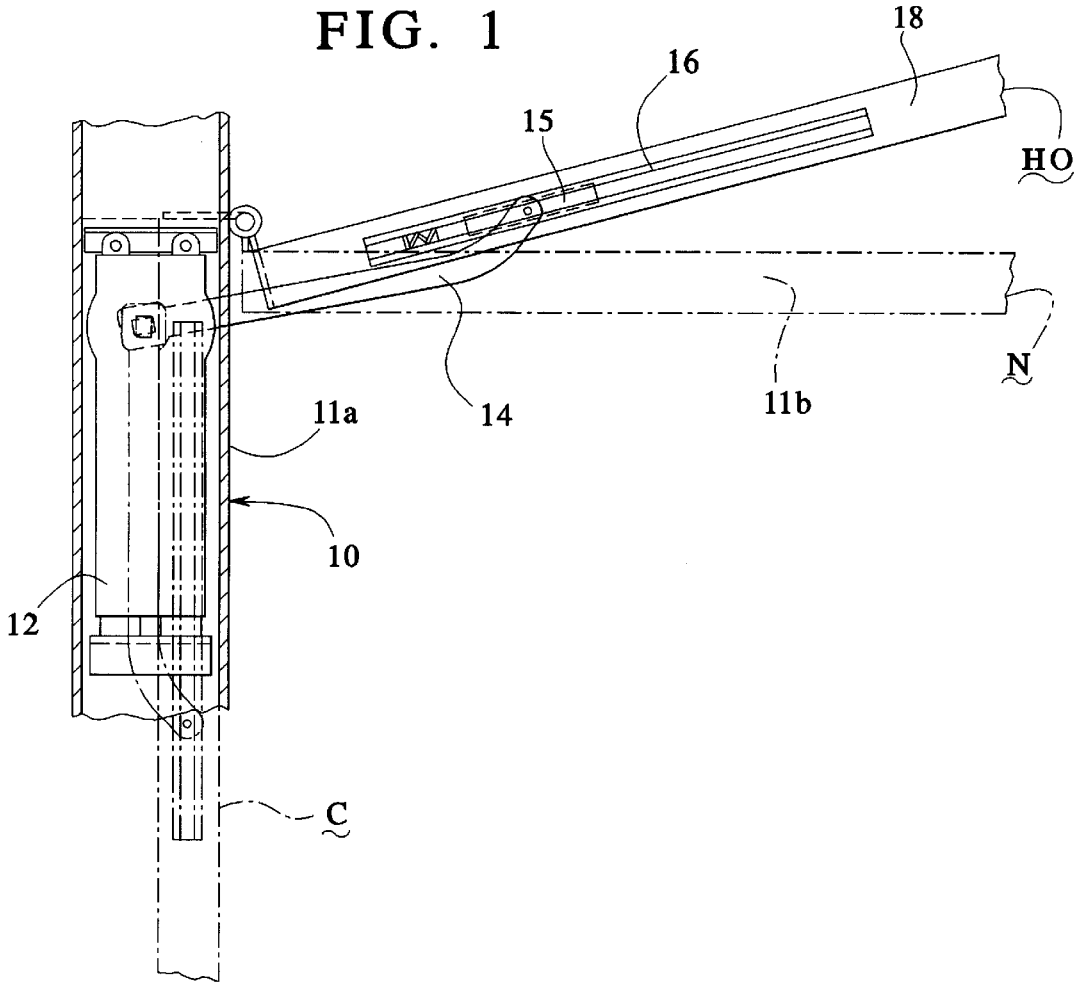
FIG. 1 is a top view of a door closer embodying the principles of the present invention which is enclosed within a door header.
Figure 6:
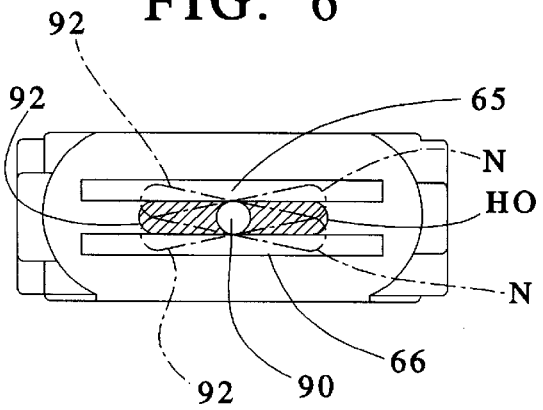
FIG. 6 is a schematic sectional view taken generally along line VI—VI of FIG. 3.
Figure 7:
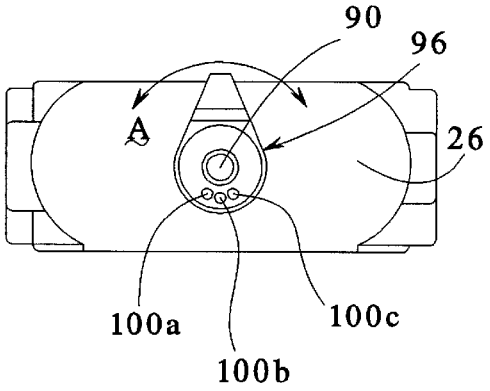
FIG. 7 is an end view of the door closer shown in FIG. 3.

The door closer embodying the principles of the invention is shown generally at 10 in FIGS. 1–9. FIG. 1 illustrates the closer 10 mounted in a concealed manner in the header portion of a door frame 11*a* and illustrating the closed C, nearly hold open N, and hold open HO positions of a door 11*b*. The closed position C is at 0°, the hold open position HO is at 105° and the nearly hold open position N is at 90°. These angles may be varied to suit the application.

The closer has a housing 12 which is connected to a door hinge arm 14. The door hinge arm 14 is connected to a slide 15 which slides along a track 16 mounted on a door 18.

Figure 2:
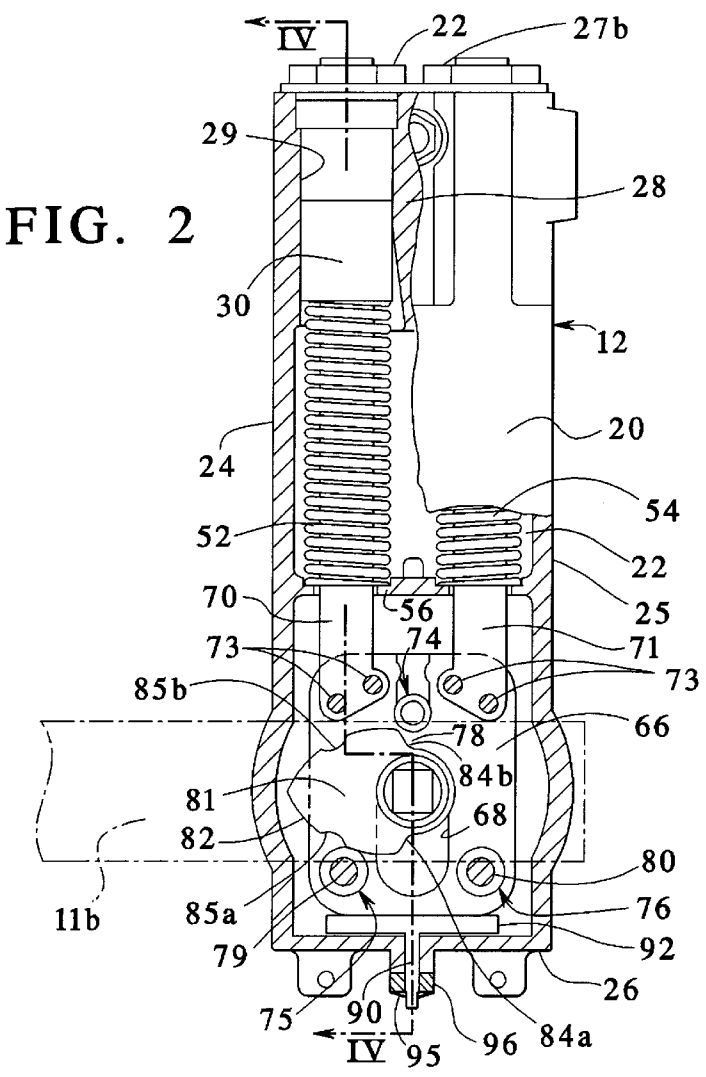
FIG. 2 is a partial sectional view of a door closer embodying the principles of the present showing the position of the cam plates when the door is nearly in the hold open position.

As seen in FIG. 2, the housing 12 is formed of a top wall 20 and a bottom wall 22, side walls 24, 25, and a rear end or back wall 26, the other end wall being provided by a pair of plug members 27*a*, 27*b*. The entire hollow portion within the housing forms a reservoir for a supply of oil or other hydraulic fluid. A central partition 28 extends partially in from one end, the partition and the side walls 24, 25 forming a pair of parallel hollow cylinders 29 for a guiding pair of pistons 30 (only one shown).

Figure 4:
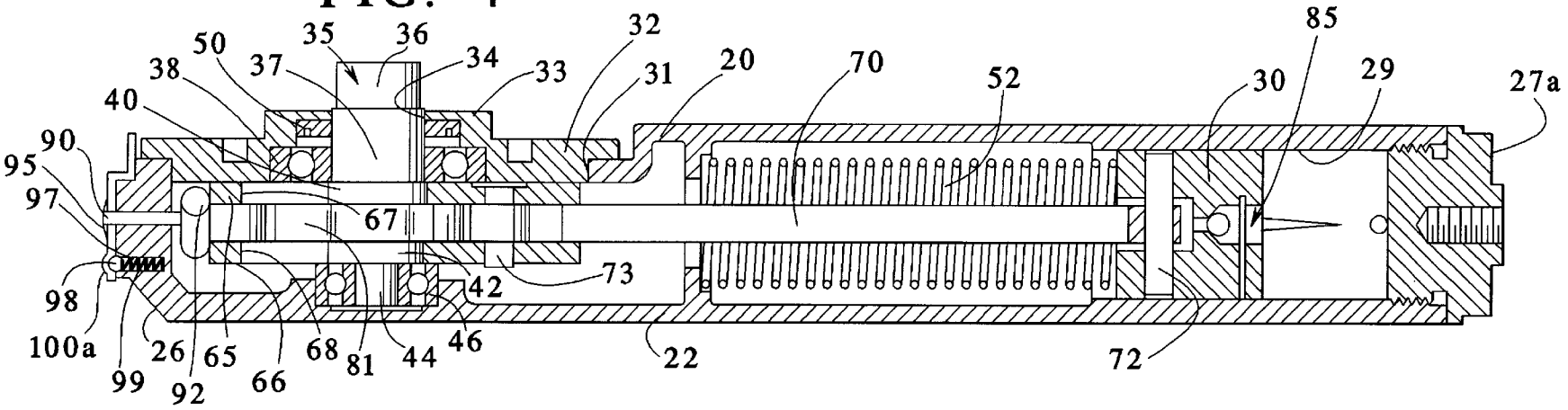
FIG. 4 is a partial side sectional view taken generally along line IV—IV of FIG. 2.

As shown in FIG. 4, the top wall 20 is provided with a threaded opening 31 in which is engaged a threaded cover plate 32, the plate having a boss 33 with a central opening 34. Extending through the opening is a spindle or door pivot member 35, this member having a non-circular end portion 36 for attachment to a door such as for reception in a non-circular hole in the door hinge arm 14. The member 35 also includes a cylindrical portion 37 journaled in a ball bearing 38, a pair of shoulder or collar portions 40, 42, and an end cylindrical portion 44 journaled in a ball bearing 46. An annular oil seal 50 is provided around the cylindrical portion 37.

The door closer 10 is provided with a pair of coiled springs 52, 54 one end of each bearing against one of a pair of internal wall portions 56, the other end bearing against one of the pistons 30. Means are provided for operably connecting the springs to the spindle member 36 and as shown in the drawings, these means may include a pair of spaced cam plate members 65, 66, each provided with a slot 67, 68 within each of which is received the appropriate one of the shoulders 40, 42. Piston rods 70, 71 are connected at one end to each of the pistons 30 by means of a pin 72. The other ends of the rods 70, 71 are secured to the plates 65, 66 by means of pins 73. The plates 65, 66 are further spaced apart by means of three cam follower rollers 74, 75 and 76 mounted for rotation on respective shafts 78, 79, and 80. A cam 81 is carried on the spindle member 36 between the shoulder portions 40, 42, the cam 81 having a cam surface 82 with a pair of hold-closed recesses 84*a*, 84*b* and a pair of hold open recesses 85*a*, 85*b*.

Valve means 86 are provided in the central partition 28 defining the cylinders 29*a*, 29*b* to regulate the door closing and latching speeds as is discussed in greater detail in U.S. Pat. No. 3,246,362.

FIG. 2 describes two separate parallel cylinders 29 utilized for regulating the closing and latching speeds, but the present invention can also be utilized in single cylinder closers. The present invention also encompasses non-hydraulic closers.

FIG. 2 illustrates a shaft 90 penetrating through the back wall 26 and connected to a limit bar 92 which is orientated widthwise across the closer 10 and positioned between the plates 65, 66 and the back wall 26.

As shown in FIG. 4, the limit bar is oriented obliquely to a horizontal axis such as to interfere with the longitudinal movement of the plates 65, 66 in a rearward direction toward the back wall 26. The limit bar 92 can press against the back wall 26 to resist movement of the plates 65, 66. The limit bar 92 stops the movement of the cam plates 65, 66 before the cam 81 and cam plates 65, 66 can reach a hold open position such as illustrated in FIGS. 3 and 5.

The shaft 90 is connected to a selector knob 96 on an outside of the rear wall 26 which allows for manual axial turning of the shaft 90 to change the orientation of the limit bar 92. A pressure washer 95 holds the knob 96 to the shaft 90 and key means (not shown) are used to ensure the shaft 90 and knob 96 turn together.

As shown in FIG. 4, a cylinder 97 is formed in the back wall 26 which receives a ball 98 and spring 99. The ball is biased outward toward the knob 96 which has three ball receiving sockets 100*a*, 100*b*, 100*c*. The sockets 100*a*, 100*c* correspond to an oblique orientation of the limit bar 92 shown as the two N positions in FIG. 6. When the knob 96 is rotated in the direction A, one of these sockets 100*a*, 100*c* will receive the ball to resiliently lock the knob in place. The center socket 100*b* corresponds to the upright position of the knob 96 shown in FIG. 7 and indicated at position HO in FIG. 6. Position N corresponds to FIG. 4 and position HO (either one) corresponds to FIG. 5.

Figure 3:
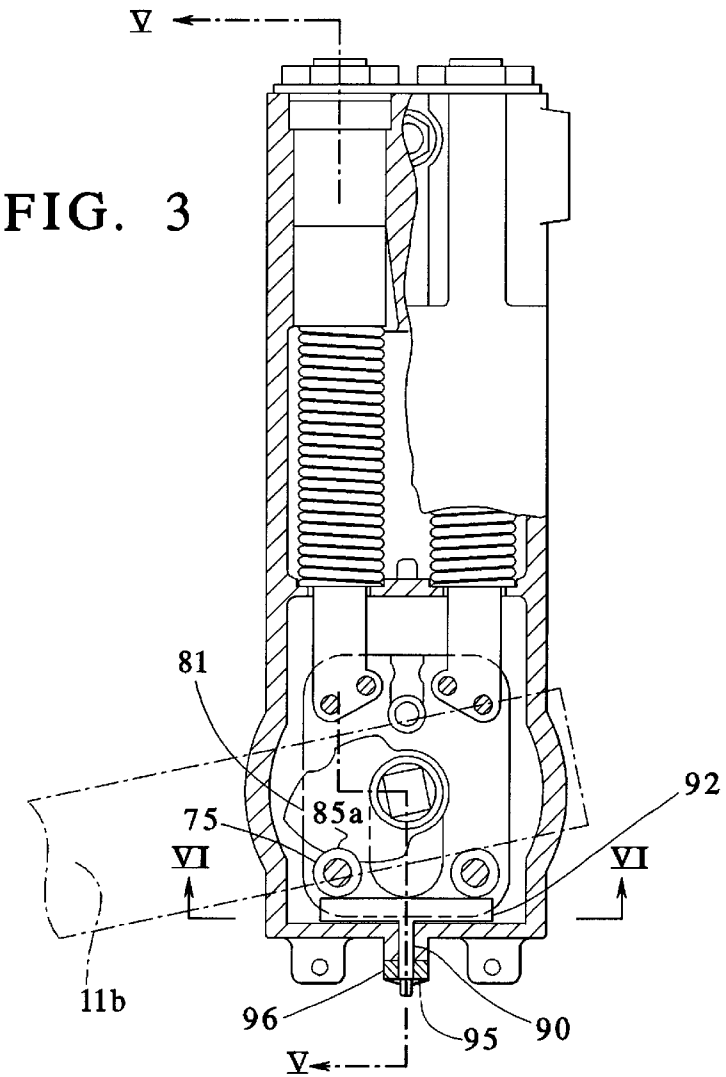
FIG. 3 is a partial sectional view of the door closer in the hold open position.
Figure 5:
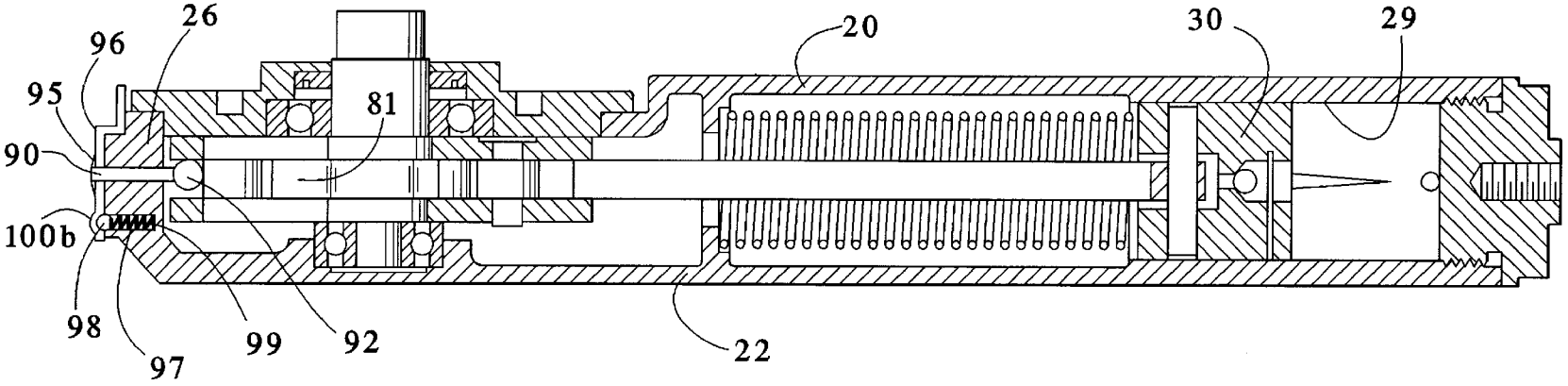
FIG. 5 is a partial side sectional view taken generally along line V—V of FIG. 3.

As shown in FIGS. 3 and 5 when the shaft is rotated to orient the limit bar in a horizontal orientation, the limit bar 92 interfits between a space located between the plates 65, 66. Thus, the plates 65, 66 can protrude rearwardly under influence of the rotating cam 81 to reach the hold open position HO wherein the cam 81 "locks up" with the plates by coaction between the cam roller 75 (or 76 depending on the direction of rotation) and the hold open recess 85*a* (or 85*b* depending on the direction of rotation) to hold the door open against the influence of the springs 52, 54 urging in a door closing direction.

Other type of cam door hold open arrangements such as disclosed in U.S. Pat. No. 4,064,589 which uses a separate and distinct hold open cam, can also utilize the present invention which prevents the cam plates from moving and thus prevents a cam from reaching a door hold open condition.

Figure 8:
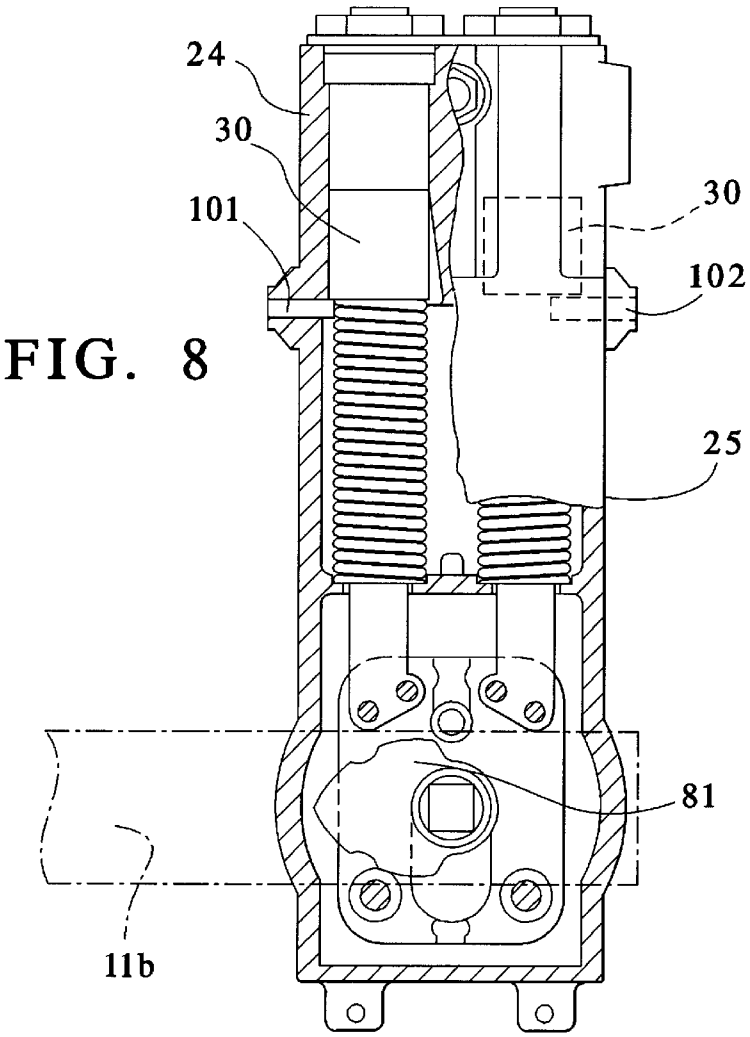
FIG. 8 is a partial sectional view of a door closer embodying an alternate embodiment of the present invention showing the position of the cam plates when the door is nearly in the hold open position.

FIG. 8 describes an alternate embodiment where the mechanism for preventing the hold open cam 81 from reaching its hold open position consists of selectively located screw pins 101, 102 penetrating into threaded holes in the side walls 24, 25 on opposite sides and extending into the path of travel of the pistons 30, 31 to block longitudinal travel of the pistons 30 to prevent the hold open cam 81 from reaching its hold open position.

Figure 9:
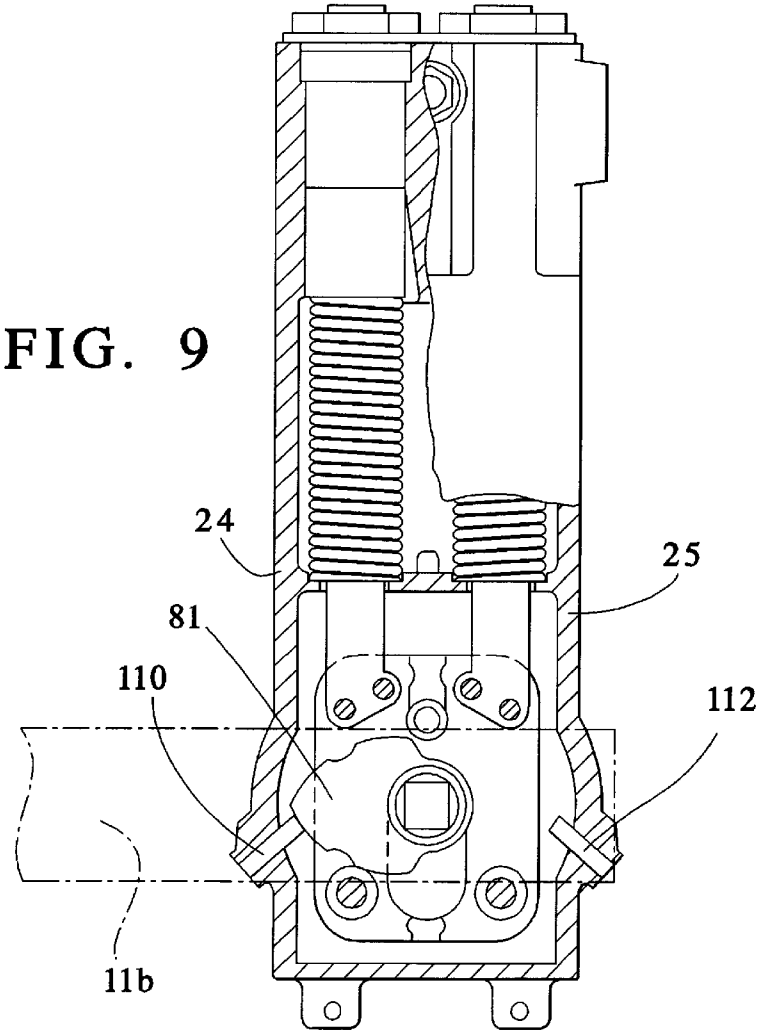
FIG. 9 is a partial sectional view of a door closer embodying an alternate embodiment of the present invention showing the position of the cam plates when the door is nearly in the hold open position.

FIG. 9 shows a further alternate embodiment where the hold open pins 101, 102 are replaced by hold open screw pins 110, 112 threaded through side walls 24, 25 at positions to interfere with the rotational movement of the cam 81 itself, the pins 110, 112 arranged for rotation of the cam in both directions to prevent a door hold open position for swinging doors which open in either direction.

Although the present invention has been described with reference to a specific embodiment, those of skill in the art will recognize that changes may be made thereto without departing from the scope and spirit of the invention as set forth in the appended claims.

I claim as my invention:

1. A door closer, comprising:

a housing mounted to one of a door or a door frame;

a spindle protruding from said housing and engaged to a respective other one of said door or said door frame to rotate proportionately to the rotation of a door to the door frame during opening and closing of the door the spindle passing through and being connected to a cam having a cam surface, the cam being eccentrically mounted to the spindle;

a moving member which moves longitudinally within said housing in response to rotation of the spindle and the cam, the moving member being operatively connected to the spindle within said housing;

a hold open means arranged in said housing for automatically engaging said cam at a select rotational angle of said spindle and said cam to seize said cam against a rotation of said spindle and said cam in a door closing direction; and a selectively actuatable block means which can be selectively rotated within said housing from a non-interfering position to an interfering position for interfering with said moving member to prevent said moving member from moving longitudinally and to prevent said spindle and said cam from rotating into said select rotational angle.

2. The door closer according to claim 1, further comprising energy storage means within said housing and operatively connected to said moving member to store energy during rotation of said spindle in a door opening rotational direction and releasing said energy to rotate the spindle in a door closing direction.

3. The door closer according to claim 1, wherein said moving member comprises a plate which moves longitudinally within said housing from force from rotation of said cam, and said selectively actuatable block means comprises a stop pin which is selectively extendable into said housing from an outside thereof to limit rotation of said cam.

4. The door closer according to claim 1, wherein said moving member comprises a member which moves longitudinally within said housing from force from rotation of said cam, and said selectively actuatable block means comprises a stop pin which is selectively extendable into said housing from an outside thereof to limit movement of said member.

5. The door closer according to claim 1, wherein said moving member comprises a plate which moves longitudinally within said housing from force from rotation of said cam, and a piston connected by a rod to said plate and said selectively actuatable block means comprises a stop pin which is selectively extendable into said housing from an outside thereof to limit movement of said piston.

6. The door closer according to claim 1, wherein said moving member comprises a plate which moves longitudinally within said housing from force from rotation of said cam, and at least one piston arranged for longitudinal movement within said housing within a cylinder, said cylinder filled with hydraulic fluid to retard movement of the piston in a door closing direction; and a spring abutting said piston and said housing to bias said piston in a door closing direction; and a piston rod connected to said piston and extending longitudinally and connected to said plate, said plate, said piston rod and said piston all moving fixedly together within said housing; and said plate comprises rollers arranged to engage said cam surface.

7. The door closer according to claim 1, wherein said housing has a back wall, and a plate which moves longitudinally within said housing from force from rotation of said cam surface, and said block means comprises a limit bar selectively arranged between said back wall and said plate to limit movement of said plate.

8. A door closer for mounting to one of a door or a door frame adjacent the door, for causing a force to close the door to the door frame, comprising:

a housing;

a spindle penetrating said housing and extending therefrom at a first end of said housing, and mounted for axial rotation with respect to said housing;

a cam mounted within said housing, to said spindle for rotation therewith, said cam having a cam surface and a recess;

a cam plate held within said housing and having a roller pressed to and riding on said cam surface, said plate movable longitudinally under force by said cam surface onto said roller when said cam is rotated, said cam and said cam plate having means for interlocking at a rotational position of said cam corresponding to an open position of said door;

a means for biasing said cam plate to resist said forced movement of said cam plate by rotation of said cam; and a selectable blocking element arranged to be rotated within said housing to prevent movement of said cam to said rotational position.

9. The door closer according to claim 8, wherein said means for biasing comprises:

a piston rod connected at one end to said cam plate;

a piston connected at a second end of said piston rod;

a spring arranged between a wall of said housing and said piston;

a cylinder formed within said housing for receiving said piston therein for reciprocal movement, said housing filled with a hydraulic fluid, hydraulic resistance of movement of said piston within said cylinder retarding the movement of said cam plate under influence of said means for biasing.

10. The door closer according to claim 9, wherein said blocking element selectively penetrates into said housing to block reciprocal movement of said piston.

11. The door closer according to claim 8, wherein said cam plate comprises two facing plates spaced apart, one on both sides of said cam, said facing plates each having a slot therethrough in registry, said spindle protruding through said slots.

12. The door closer according to claim 11, wherein said housing has a back wall and said blocking element comprises a generally horizontal bar arranged between said facing plates and said back wall of said housing, said horizontal bar arranged and sized to interfit within a clearance provided between said facing plates when oriented in a first orientation, and arranged to interfere with said facing cam plates when oriented in a second orientation, said interference sized and arranged to prevent said cam and cam plate from reaching the hold open position.

13. The door closer according to claim 9, wherein said blocking element selectively penetrates into said housing to block said cam surface against rotation into said rotational position.

14. In a door closer having a housing in which is held a reciprocating moving member, and a spindle protruding into said housing and having a cam fixed thereto, the cam having a cam surface for imparting a force on said member to move said member, and a spring for biasing said member toward a first direction to impart a rotation to said cam and said spindle corresponding to a door closing rotation direction, the cam and moving member having means applied therebetween for holding the door at an open and fixed rotational position against the urging of the spring toward a door closing rotation, the improvement comprising:

a blocking device arranged for rotation within said housing to block movement of said cam and said reciprocating moving member into a position of engagement by said means for holding the door.

15. The improvement according to claim 14, wherein said blocking device comprises a bar which can be rotated from outside said housing to attain two orientations, a first orientation interfering with movement of said reciprocating moving member and a second orientation allowing said reciprocating moving member to pass by said bar without interference.

16. The improvement according to claim 14, wherein said blocking device is a screw which can be threadingly inserted into said housing to interfere with movement of said reciprocating moving member.

17. The improvement according to claim 14, wherein said blocking device comprises a screw threadingly insertable into said housing to interfere with rotation of said cam.

* * * * *